US010138081B2

(12) United States Patent
Shimosaka et al.

(10) Patent No.: US 10,138,081 B2
(45) Date of Patent: Nov. 27, 2018

(54) PAPER FEEDING ROLLER WITH PATTERN

(71) Applicant: PFU LIMITED, Kahoku-shi, Ishikawa (JP)

(72) Inventors: Kiichiro Shimosaka, Kahoku (JP); Shuichi Morikawa, Kahoku (JP)

(73) Assignee: KIANA ANALYTICS INC., Sunnyvale, CA (US)

( * ) Notice: Subject to any disclaimer, the term of this patent is extended or adjusted under 35 U.S.C. 154(b) by 0 days.

(21) Appl. No.: 15/174,861

(22) Filed: Jun. 6, 2016

(65) Prior Publication Data

US 2017/0113889 A1 Apr. 27, 2017

(30) Foreign Application Priority Data

Oct. 23, 2015 (JP) ..... 2015-209201

(51) Int. Cl.

| | |
|---|---|
| ***B65H 5/02*** | (2006.01) |
| ***B65H 3/06*** | (2006.01) |
| ***B65H 5/06*** | (2006.01) |
| *B65H 27/00* | (2006.01) |

(52) U.S. Cl.

CPC ..... *B65H 3/0638* (2013.01); *B65H 3/063* (2013.01); *B65H 3/0653* (2013.01); *B65H 5/062* (2013.01); *B65H 27/00* (2013.01); *B65H 2404/11* (2013.01); *B65H 2404/1118* (2013.01); *B65H 2404/1119* (2013.01); *B65H 2404/1141* (2013.01)

(58) Field of Classification Search

CPC ..... B65H 27/00; B65H 2404/11; B65H 2404/1118; B65H 2404/1141

See application file for complete search history.

(56) References Cited

U.S. PATENT DOCUMENTS

| | | | | |
|---|---|---|---|---|
| 5,431,358 | A * | 7/1995 | Alexander, III | B65H 16/106 139/304 |
| 8,973,267 | B2 * | 3/2015 | Gelli | B23C 3/32 29/895.3 |
| 2002/0130460 | A1 | 9/2002 | Yoshida et al. | |
| 2004/0026844 | A1 * | 2/2004 | Toriumi | B65H 27/00 271/109 |

(Continued)

FOREIGN PATENT DOCUMENTS

| | | |
|---|---|---|
| JP | 9-183533 A | 7/1997 |
| JP | 11-106067 | 4/1999 |

(Continued)

OTHER PUBLICATIONS

Office action dated Nov. 1, 2016 in corresponding JP Patent Application No. 2015-209201, including Eng. translation, 6pp.

(Continued)

*Primary Examiner* — Howard J Sanders

(74) *Attorney, Agent, or Firm* — Lewis Roca Rothgerber Christie LLP

(57) ABSTRACT

A feeding roller for a document conveying apparatus includes a plurality of groove portions arranged with a regular interval in a width direction of the feeding roller on a surface of the feeding roller, and a projection portion provided between each pair of adjacent groove portions to scrape off paper particles on the external peripheral. The projection portion has a regular pattern extending in the width direction of the feeding roller.

5 Claims, 8 Drawing Sheets

(56) References Cited

U.S. PATENT DOCUMENTS

2008/0061495 A1 3/2008 Shiraki

FOREIGN PATENT DOCUMENTS

| | | | |
|---|---|---|---|
| JP | 2000-118778 | | 4/2000 |
| JP | 3429878 | B2 | 7/2003 |
| JP | 4042806 | B1 | 2/2008 |
| JP | 2013-95540 | | 5/2013 |
| JP | 2015-86043 | | 5/2015 |

OTHER PUBLICATIONS

CN Office Action, dated Jul. 31, 2017 regarding Chinese Patent Application No. 201610607244.5 corresponding to U.S. Appl. No. 15/174,861, (6 pages) with English Translation (7 pages).

* cited by examiner

PAPER FEEDING ROLLER WITH PATTERN

CROSS-REFERENCE TO RELATED APPLICATIONS

This application is based upon and claims the benefit of priority of prior Japanese Patent Application No. 2015-209201, filed on Oct. 23, 2015, the entire contents of which are incorporated herein by reference.

TECHNICAL FIELD

Embodiments discussed in the present specification relate to a feeding roller used in a document conveying apparatus.

BACKGROUND

Paper particles may be applied to the surfaces of offset printed documents in order to prevent printed materials from coming into contact with each other, and prevent ink smear on the back surface caused by such printed materials coming into contact with each other. When such a document is conveyed by a document conveying apparatus such as a scanner apparatus, the paper particles that stick to the surface of the document adhere to a roller for conveying the document, which reduces the friction coefficient of rubber, and may reduce the conveying performance.

A feeding roller in which many grooves and many groove projections of which cross section forms an asymmetrical waveform shape are formed on an external periphery in a direction perpendicular to a paper conveying direction is disclosed (see Japanese Patent No. 3429878).

A paper feeding roller in which multiple recessed grooves extending in an axial direction on an external periphery of an elastic layer are formed with a predetermined pitch in a peripheral direction, and the external peripheral other than the recessed grooves of the elastic layer and bottom surfaces and side wall surfaces of the recessed grooves are formed into an emboss surface constituted by projection shaped portions and recess shaped portions is disclosed (see Japanese Patent No. 4042806).

A paper feeding roller in which recesses and projections are provided on the roller surface and only the inner peripheral surfaces of the recessed portions are halogenated is disclosed (see Japanese Laid-open Patent Publication No. H11-106067).

A feeding roller having spherical silicone powder and/or polar silicone oil mixed in high-polymer material is disclosed (see Japanese Laid-open Patent Publication No. 2000-118778).

A conveying roller in which surface processing such as emboss processing, knurling processing, groove processing is applied as necessary to the surface of a rubber elastic body is disclosed (see Japanese Laid-open Patent Publication No. 2013-095540).

SUMMARY

In a document conveying apparatus, it is desired to be able to alleviate the reduction of the conveying performance caused by paper particles sticking to a feeding roller.

It is an object to provide a feeding roller capable of alleviating reduction of the conveying performance caused by sticking of paper particles in a document conveying apparatus.

According to an aspect of the device, there is provided a feeding roller for a document conveying apparatus. The document conveying apparatus includes a plurality of groove portions arranged with a regular interval in a width direction of the feeding roller on a surface of the feeding roller, and a projection portion provided between each pair of adjacent groove portions to scrape off paper particles on the external peripheral, wherein the projection portion has a regular pattern extending in the width direction of the feeding roller.

The object and advantages of the invention will be realized and attained by means of the elements and combinations particularly pointed out in the claims. It is to be understood that both the foregoing general description and the following detailed description are exemplary and explanatory, and are not restrictive of the invention, as claimed.

DESCRIPTION OF EMBODIMENTS

Hereinafter, a feeding roller and a document conveying apparatus according to an embodiment, will be described with reference to the drawings. However, it should be noted that the technical scope of the invention is not limited to these embodiments, and extends to the inventions described in the claims and their equivalents.

Figure 1:
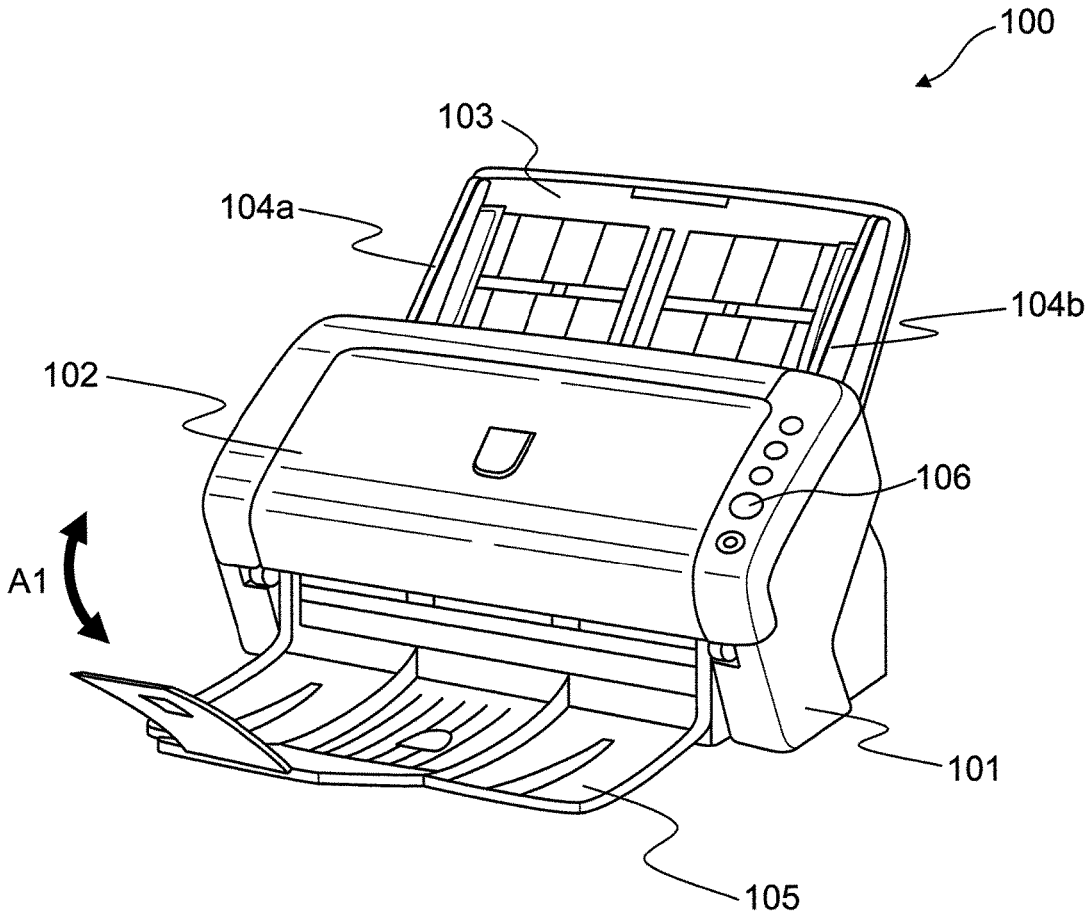
FIG. 1 is perspective view illustrating a document conveying apparatus 100 according to an embodiment.

FIG. 1 is perspective view illustrating a document conveying apparatus 100 configured as an image scanner according to an embodiment.

The document conveying apparatus 100 includes a lower side housing 101, an upper side housing 102, a document tray 103, a discharged sheet stacker 105, an operation button 106, etc.

The upper side housing 102 is arranged at a position to cover the upper surface of the document conveying apparatus 100, and is attached to the lower side housing 101 with a hinge so as to be able to open and close, when a document is jammed, or when the inside of the document conveying apparatus 100 is cleaned up, etc.

The document tray 103 is engaged with the lower side housing 101 in such a manner that the document can be placed on the document tray 103. The document tray 103 is provided with side guides 104*a* and 104*b* which can move in a direction perpendicular to the conveying direction of the document. Hereinafter, the side guides 104*a* and 104*b* may be collectively referred to as side guides 104.

The discharged sheet stacker 105 is attached to the lower side housing 101 with a hinge in such a manner that the discharged sheet stacker 105 can pivot in a direction indicated by arrow A1, and in the open state as depicted in FIG. 1, the discharged sheet stacker 105 can hold the discharged documents.

The operation button 106 is arranged on the surface of the upper side housing 102, and when the operation button 106 is pressed down, the operation button 106 generates and outputs an operation detection signal.

Figure 2:
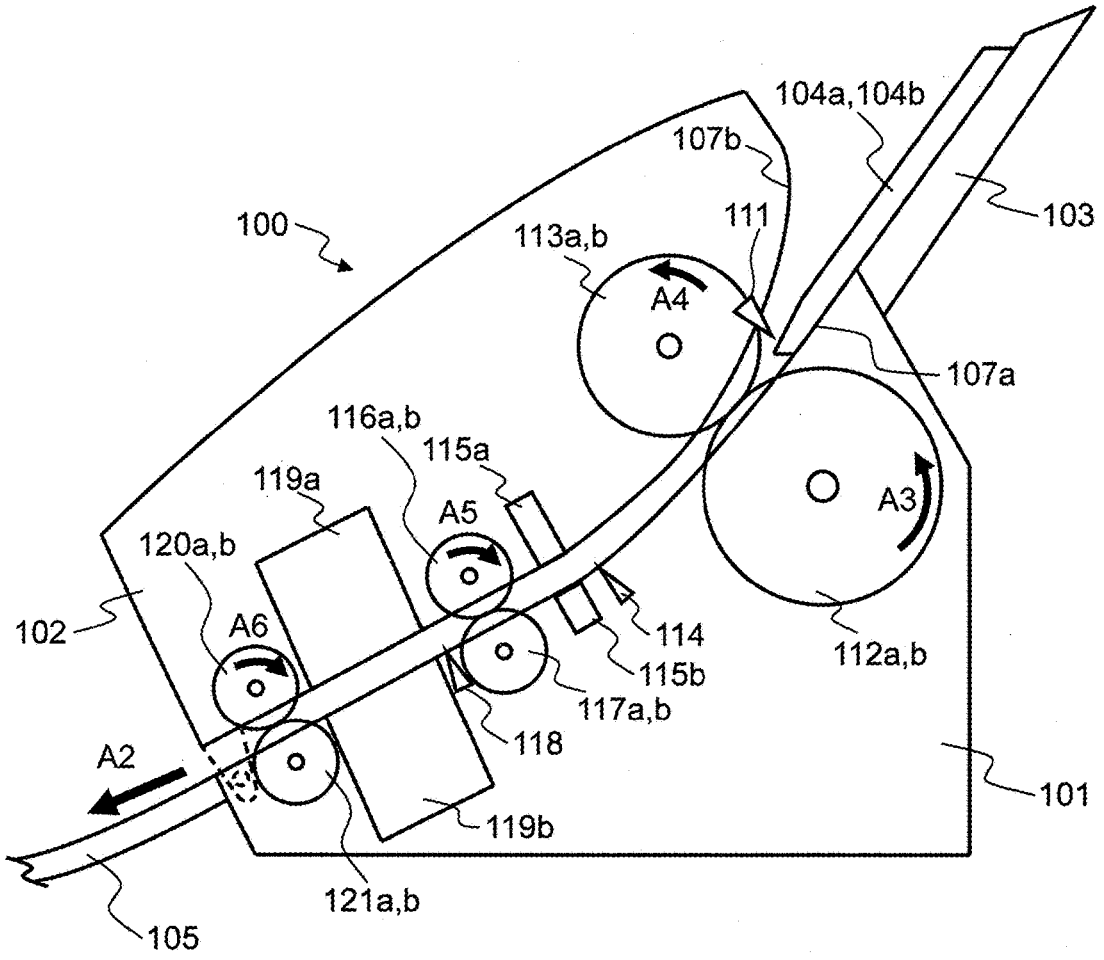
FIG. 2 is a figure for explaining a conveying path inside of the document conveying apparatus 100.

FIG. 2 is a figure for explaining a conveying path inside of the document conveying apparatus 100.

The conveying path inside of the document conveying apparatus 100 includes a first document detector 111, feeding rollers 112*a*, 112*b*, brake rollers 113*a*, 113*b*, a second document detector 114, an ultrasonic transmitter 115*a*, an ultrasonic receiver 115*b*, first conveying rollers 116*a*, 116*b*, first driven rollers 117*a*, 117*b*, a third document detector 118, a first image capturing module 119*a*, a second image capturing module 119*b*, second conveying rollers 120*a*, 120*b* and second driven rollers 121*a*, 121*b*, etc.

In the following explanation, the feeding rollers 112*a* and 112*b* may be collectively referred to as the feeding roller 112. The brake rollers 113*a* and 113*b* may be collectively referred to as the brake roller 113. The first conveying rollers 116*a* and 116*b* may be collectively referred to as the first conveying roller 116. The first driven rollers 117*a* and 117*b* may be collectively referred to as the first driven roller 117. The second conveying rollers 120*a* and 120*b* may be collectively referred to as the second conveying roller 120. The second driven rollers 121*a* and 121*b* may be collectively referred to as the second driven roller 121.

The upper surface of the lower side housing 101 forms a lower side guide 107*a* of the conveying route for the documents, and the lower surface of the upper side housing 102 forms an upper side guide 107*b* of the conveying route for the documents. In FIG. 2, arrow A2 indicates the conveying direction of the documents. In the following explanation, the upstream means the upstream in the conveying direction A2 of the documents, and the downstream means the downstream in the conveying direction A2 of the documents.

The first document detector 111 includes a contact detection sensor provided at the upstream side with respect to the feeding roller 112 and the brake roller 113, and the contact detection sensor detects whether or not a document is placed on the document tray 103. The first document detector 111 generates and outputs a first document detection signal of which signal value changes depending on a state in which the document is placed on the document tray 103 and a state in which the document is not placed on the document tray 103.

The second document detector 114 includes a contact detection sensor provided at the downstream side with respect to the feeding roller 112 and the brake roller 113 and at the upstream side with respect to the first conveying roller 116 and the first driven roller 117, and the contact detection sensor detects whether a document exists at that position or not. The second document detector 114 generates and outputs a second document detection signal of which signal value changes depending on a state in which a document exists at that position and a state in which any document does not exist at that position.

The ultrasonic transmitter 115*a* and the ultrasonic receiver 115*b* are arranged in proximity to the conveying route for the documents so as to face each other with the conveying route interposed therebetween. The ultrasonic transmitter 115*a* transmits an ultrasonic wave. On the other hand, the ultrasonic receiver 115*b* detects the ultrasonic wave that has been transmitted by the ultrasonic transmitter 115*a* and that has passed through a document, and generates and outputs an ultrasonic signal which is an electric signal according to the detected ultrasonic wave. In the following explanation, the ultrasonic transmitter 115*a* and the ultrasonic receiver 115*b* may be collectively referred to as the ultrasonic sensor 115.

The third document detector 118 includes a contact detection sensor provided at the downstream side with respect to the first conveying roller 116 and the first driven roller 117 and at the upstream side with respect to the first image capturing module 119*a* and the second image capturing module 119*b*, and the contact detection sensor detects whether a document exists at that position. The third document detector 118 generates and outputs a third document detection signal of which signal value changes depending on a state in which a document exists at that position and a state in which any document does not exist at that position.

The first image capturing module 119*a* includes an image capturing sensor of a reduced optical system type having an image capturing device based on CCD (Charge Coupled Device) arranged in a linear manner in a main scanning direction. This image capturing sensor reads the back surface of the document, and generates and outputs an analog image signal. Likewise, the second image capturing module 119*b* includes an image capturing sensor of a reduced optical system type based on CCD arranged in the linear manner in the main scanning direction. This image capturing sensor generates and outputs an analog image signal by reading the front surface of the document. It should be noted that only one of the first image capturing module 119*a* and the second image capturing module 119*b* may be provided to read only one of the surfaces of a document. Alternatively, it may possible to use a CIS (Contact Image Sensor) of the same-size optical system type having an image capturing device based on CMOS (Complementary Metal Oxide Semiconductor) instead of the CCD. Hereinafter, the first image capturing module 119*a* and the second image capturing module 119*b* may be collectively referred to as the image capturing module 119.

When the feeding roller 112 rotates in the direction indicated by arrow A3 of FIG. 2, the document placed on the document tray 103 is conveyed between the lower side guide 107*a* and the upper side guide 107*b* in the document conveying direction A2. While the document is conveyed, the brake roller 113 rotates in the direction of the arrow A4 of FIG. 2. When multiple documents are placed on the document tray 103, only one of the documents placed on the document tray 103 that is in contact with the feeding roller 112 is separated with the action of the feeding roller 112 and the brake roller 113. Therefore, this operates so as to limit the conveying of a document other than the separated document (prevention of multifeed). The feeding roller 112 and the brake roller 113 functions as a separation module for a document.

The document is fed between the first conveying roller 116 and the first driven roller 117 while the document is guided by the lower side guide 107*a* and the upper side guide 107*b*. When the first conveying roller 116 rotates in the direction of the arrow A5 of FIG. 2, the document is fed between the first image capturing module 119*a* and the second image capturing module 119*b*. When the second conveying roller 120 rotates in the direction of the arrow A6 of FIG. 2, the document, which has been read by the image capturing module 119, is discharged onto the discharged sheet stacker 105.

Figure 3A:
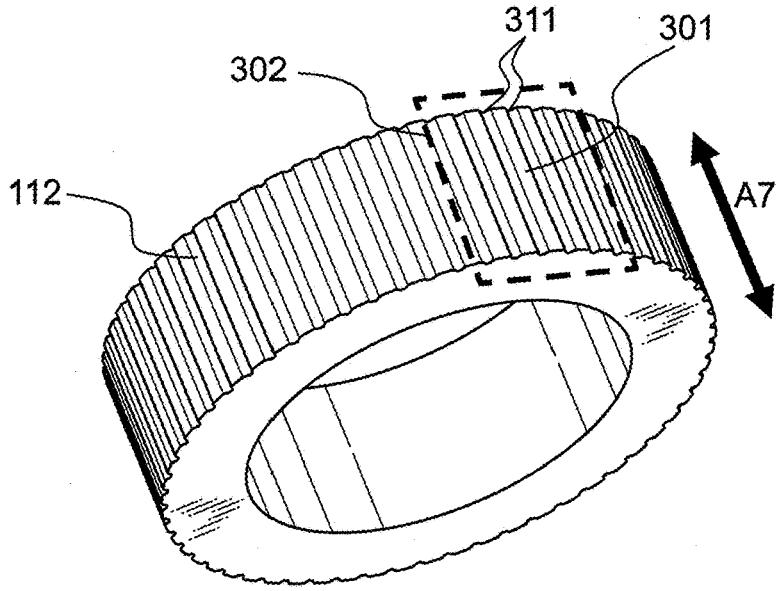
FIG. 3A is perspective view of a feeding roller 112.

FIG. 3A is perspective view illustrating the feeding roller 112 used for the document conveying apparatus 100.

As depicted in FIG. 3A, the external periphery 301 of the feeding roller 112 includes multiple groove portions 311 provided in multiple width directions of the feeding roller 112 (direction of the arrow A7). The groove portions 311 are formed by knurling processing, and are arranged with a regular interval in the circumferential direction of the feeding roller 112. In other words, a plurality of groove portions is arranged with a regular interval in a width direction of the feeding roller 112 on a surface of the feeding roller. The groove portions 311 can accumulate paper fibers (cellulose) of about 0.1 [mm] to 0.5 [mm]. Therefore, when the feeding roller 112 has the groove portions 311 on the external periphery 301, the paper particles get into between the document and the external periphery 301, so that this can alleviate the reduction of the conveying force of the documents.

Figure 3B:
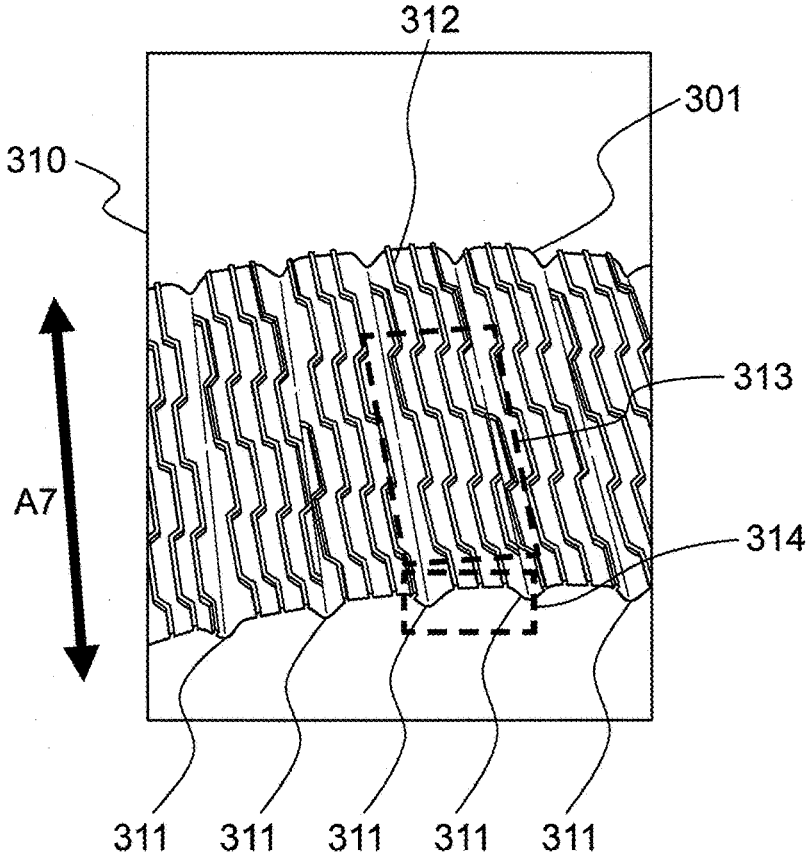
FIG. 3B is perspective view for explaining an external periphery 301 of a feeding roller 112.

FIG. 3B is perspective view for explaining the external periphery 301 of the feeding roller 112.

An image 310 as depicted in FIG. 3B is an enlarged view illustrating a part 302 of the external periphery 301 of the feeding roller 112 depicted in FIG. 3A. As depicted in FIG. 3B, the external periphery 301 has a projection portion 312 provided between each pair of adjacent groove portions 311. The projection portions 312 are formed by emboss processing, and has a regular pattern extending in the width direction A7 of the feeding roller 112, and the projection portions 312 scrape off the paper particles sticking to the documents being conveyed. The regular pattern is, for example, a waveform shape. The paper particles are smaller than paper fibers (about 20 [μm]). When there is no projection portion 312 between adjacent groove portions 311 and the surface between adjacent groove portions 311 is flat, much paper particles stick to the surface. When the feeding roller 112 has the projection portions 312 on the external periphery 301, the paper particles, which used to stick to the conveyed document, do not get into the recessed portion between the projection portions 312 and spread to the entire external periphery 301, and therefore, this can alleviate the reduction of the conveying force.

Figure 4:
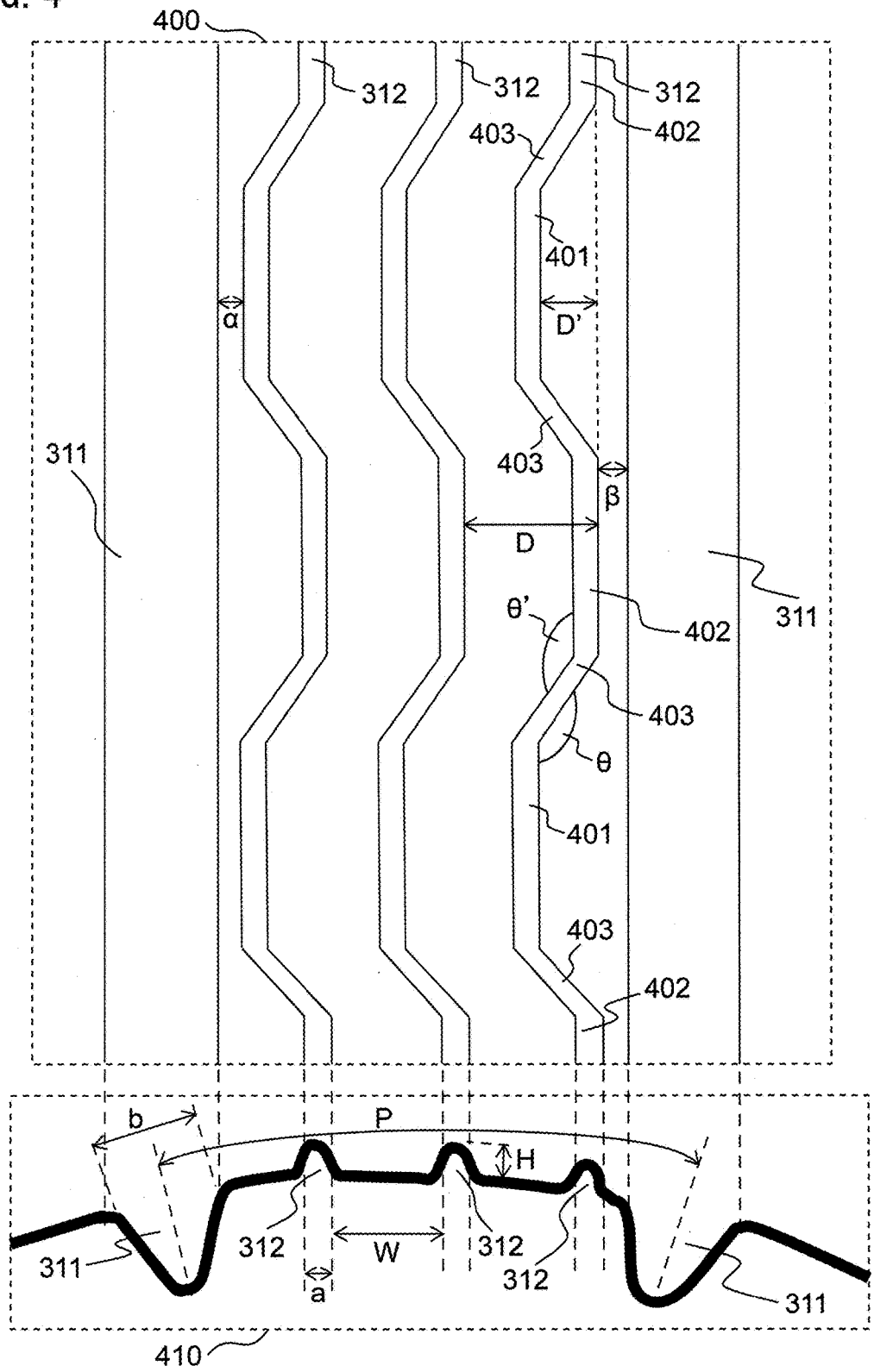
FIG. 4 is a schematic view for explaining an external periphery 301 of the feeding roller 112.

FIG. 4 is a schematic view for explaining the external periphery 301 of the feeding roller 112 into details.

An image 400 as depicted in FIG. 4 is an enlarged view, which is seen in a radius direction of the feeding roller 112, illustrating a part 313 of the external periphery 301 of the feeding roller 112 depicted in FIG. 3B. An image 410 as depicted in FIG. 4 is an enlarged view, which is seen in an axial direction of the feeding roller 112, illustrating a part 314 of the feeding roller 112 depicted in FIG. 3B.

As depicted in the image 400, the waveform shape of the projection portion 312 is in a trapezoid waveform shape. The trapezoid waveform shape includes multiple parallel portions 401, 402 arranged substantially in parallel with the groove portions 311. The multiple parallel portions 401, 402 are arranged in a dispersed manner, and the trapezoid waveform shape further includes a leg portion 403 connecting between multiple parallel portions 401, 402.

When the waveform shape of the projection portions 312 are made into the trapezoid waveform shapes, the paper particles are efficiently scraped off by the leg portions 403, and therefore, this prevents the paper particles from spreading to the entire external periphery 301, and therefore, this can alleviate the reduction of the conveying force.

It should be noted that the waveform shape of the projection portion 312 is not limited to the trapezoid waveform shape, and the waveform shape of the projection portion 312 may be a sine waveform shape, a sawtooth waveform shape, a rectangular waveform shape, a triangular waveform shape, etc. When the waveform shape is the sine waveform shape, the sawtooth waveform shape, or the triangular waveform shape, there does not exist any projection portion perpendicular to the document conveying direction, and when the waveform shape is the sine waveform shape or the rectangular waveform shape, there does not exist any projection portion inclined with respect to the document conveying direction. When the waveform shape is the sine waveform shape, the sawtooth waveform shape, the rectangular waveform shape, or the triangular waveform shape, the scraping efficiency of the paper particles is lower than that of the trapezoid waveform shape, but the paper particles sticking to the conveyed document can be somewhat scraped off.

In the trapezoid waveform shape, the angle θ formed by the leg portion 403 and the parallel portion 401 corresponding to the upper base portion of a trapezoid is about 135 degrees. When the angle θ is about 135 degrees, the angle θ' formed by the leg portion 403 and the parallel portion 402 corresponding to the lower base portion of a trapezoid is also about 135 degrees. More specifically, no matter which of the parallel portion 401 corresponding to the upper base portion of a trapezoid and the parallel portion 402 corresponding to the lower base portion of a trapezoid is provided at the upstream side in the document conveying direction, the same scraping effect can be obtained. Therefore, in the assembly work of the document conveying apparatus 100, it is not necessary to consider the direction of the external periphery 301 with respect to the document conveying direction, and this can improve the assembly work efficiency.

As a result of experiments using various kinds of documents, it is found that, when the angle θ formed by the leg portion 403 and the parallel portion 401 corresponding to the upper base portion of a trapezoid is equal to or more than 120 degrees and equal to or less than 150 degrees, a certain quantity of paper particles or more can be scraped off. Therefore, when the angle θ is equal to or more than 120 degrees and equal to or less than 150 degrees, a certain level of scraping effect can be obtained no matter which of the parallel portion 401 corresponding to the upper base portion of a trapezoid and the parallel portion 402 corresponding to the lower base portion of a trapezoid is provided at the upstream side in the document conveying direction. More specifically, in the assembly work of the document conveying apparatus 100, even when the direction of the external periphery 301 with respect to the document conveying direction is assembled in a wrong manner, the document conveying apparatus 100 can scrape off paper particles without any problem.

Since the projection portion 312 is in the trapezoid waveform shape, the projection portions 312 come into contact with the document at both of the position of the parallel portion 401 corresponding to the upper base portion of a trapezoid and the position of the parallel portion 402 corresponding to the lower base portion of a trapezoid in the document conveying direction. Therefore, as compared with the case where the projection portion 312 is a straight line shape, the contact range between the projection portion 312 and the document in the document conveying direction becomes larger, and the pressure given by the document to the feeding roller 112 can be reduced. When a distance D' between the parallel portion 401 corresponding to the upper base portion and the parallel portion 402 corresponding to the lower base portion of a trapezoid is configured to be about ½ of a distance D between trapezoid waves adjacent to each other, the pressure given by the document to the feeding roller 112 can be reduced more efficiently. Therefore, the document conveying apparatus 100 can alleviate degradation of the projection portions 312.

As a result of an experiment of repeatedly conveying documents, it is found that, when the distance D' between adjacent parallel portions 401, 402 is equal to or more than ⅓ and equal to or less than ⅔ of the distance D between the trapezoid waves adjacent to each other, the degradation of the projection portion 312 can be alleviated. Therefore, the distance D' between adjacent parallel portions 401, 402 is preferably equal to or more than ⅓ and equal to or less than ⅔ of the distance D between the trapezoid waves adjacent to each other.

As described above, two or more projection portions 312 are preferably provided between multiple adjacent groove portions 311, so that the paper particles sticking to a conveyed document get into the recessed portion between the projection portions 312.

When the height H of the projection portion 312 is higher, the size of area of the projection portion 312 coming into contact with the paper particles becomes larger, and this improves the scraping performance for scraping the paper particles. Likewise, when the width W of the recessed portion between the projection portions 312 is smaller, the frequency at which the projection portion 312 comes into contact with the document becomes higher, and this improves the scraping performance for scraping the paper particles. On the other hand, when the width a of the projection portion 312 is smaller, the projection portion 312 is more likely to collapse which makes it impossible to come into contact with the powder paper particle, and this reduces the scraping performance for scraping the paper particles.

When the height H of the projection portion 312 is higher, the stability of the projection portion 312 may become lower, and the conveying performance of the document is reduced. On the contrary, when the width W of the recessed portion between the projection portions 312 is smaller or when the width a of the projection portion 312 is larger, the ratio at which the conveyed document comes into contact with the projection portion 312 becomes higher, and the conveying performance for conveying the documents is improved.

When the height H of the projection portion 312 is lower, the ease of production of the projection portion 312 (the ease of the emboss processing and the release property for releasing from a mold) is improved. When the width W of the recessed portion between the projection portions 312 is larger, the ease of production of the recessed portion (the release property for releasing from a mold) is improved. When the width a of the projection portion 312 is larger, the ease of production of the projection portion 312 (the ease of the emboss processing and the ease of molding) is improved.

As described above, depending on the width, the height, and the interval of the projection portion 312, each performance is greatly changed. In the following explanation, the width, the height, and the interval of the projection portion 312 will be explained in more details.

The number of projection portions 312 provided between each pair of adjacent groove portions 311 will be denoted as n. The width of the recessed portion between each pair of adjacent projection portions 312 will be denoted as W. The pitch between each pair of adjacent groove portions 311 will be denoted as P. The width of the projection portion 312 will be denoted as a. The width of the groove portion 311 will be denoted as b. There are margins α, βbetween any given groove portion 311 and a projection portion 312 existing most closely to the groove portion 311, and therefore, when the distance D' between the parallel portion 401 and the parallel portion 402 is ½ of the distance D between trapezoid waves adjacent to each other, the following relational expression is established.

$$W\times\{(n-1)+½\}+(n\times a)<(P-b) \quad (1)$$

The following relational expression is established from the above expression (1).

$$W<(P-b-n\times a)\times\{1/(n-½)\} \quad (2)$$

The width a of the projection portion 312 is preferably larger than diameter of the paper particle, and is, for example, configured to be a value larger than 20 [μm], so that the projection portion 312 can sufficiently come into contact with the conveyed document, even in a state where the paper particles are sticking to the upper surface of the projection portion 312.

Figure 5:
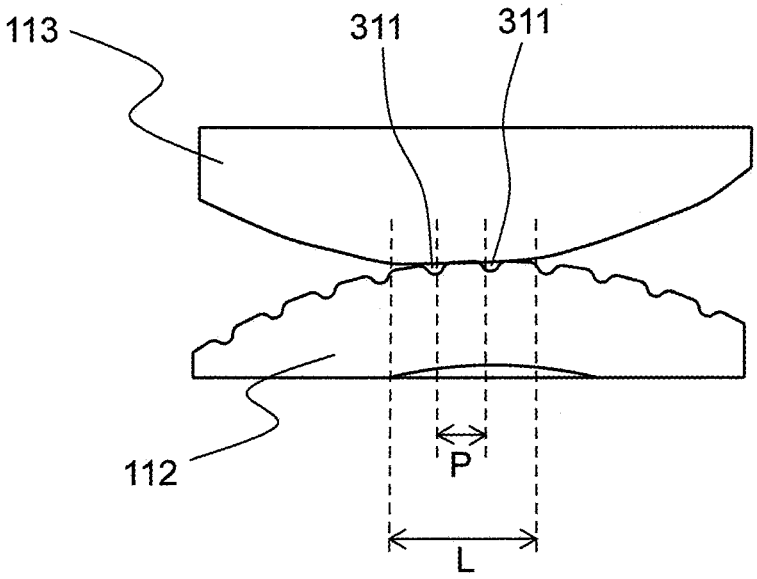
FIG. 5 is a schematic view illustrating a relationship between a brake roller 113 and the feeding roller 112.

FIG. 5 is a schematic view illustrating a relationship between the brake roller 113 and the feeding roller 112.

As depicted in FIG. 5, in order to improve the conveying performance with the feeding roller 112 and the brake roller 113 provided opposite to the feeding roller 112, at least one or more groove portions 311 is needed to be included in the nip portion between the feeding roller 112 and the brake roller 113. Therefore, the pitch P between each pair of adjacent groove portions 311 needs to be smaller than the nip width L between the feeding roller 112 and the brake roller 113. Therefore, the above expression (2) is transformed as shown the following relational expression.

$$W<(L-b-n\times a)\times\{1/(n-½)\} \quad (3)$$

It should the nip width L is defined from the roller diameter of the brake roller 113 and the roller diameter of the feeding roller 112. For example, when the roller diameter of the brake roller 113 is 30 mm, and the roller diameter of the feeding roller 112 is 30 to 50 mm, the nip width L is 4 to 6 mm.

Back to FIG. 4, the height H of the projection portion 312 is preferably larger than the diameter of the paper particle, and is, for example, configured to be a value larger than 20 [μm], so that the paper particles scraped off by each projection portion 312 get into between the projection portions 312 and thereafter do not come into contact with the document. Likewise, the width W of the recessed portion between adjacent projection portions 312 is also preferably larger than the diameter of the paper particle, and is, for example, configured to be a value larger than 20 [μm]. However, when the strength required for the mold used to form the feeding roller 112 is considered, the width W of the recessed portion is required to be set to a value as large as a predetermined times T (T is, for example, 5) the height H of the projection portion 312. Therefore, the following relational expression is established.

$$H<W\times(1/T)<(L-b-n\times a)\times\{1/(n-½)\}\times(1/T) \quad (4)$$

More specifically, the height H of the projection portion 312 is set to a value less than [(L−b−n×a)× {1/(n−½)}×(1/T)].

On the contrary, when the minimum value of the height H of the projection portion 312 is set to 20 [μm], the minimum value Wmin, which the width W of the recessed portion could be, is set to 20 [μm]×T. In this case, the following relational expression is established from the expression (3).

$$a<[\{L-b-W\min\times(n-1/2)\}/n] \quad (5)$$

The following relational expression is established from the expression (2).

$$P>W\min\times(n-1/2)b+n\times a \quad (6)$$

Hereinafter, where the number n of projection portions 312 provided between adjacent groove portions 311 is 2, the nip width L is 5 mm, the width b of the groove portion 311 is 0.5 mm, and T is 5, the numerical value example of each module will be explained where it is desired to reduce the effect of the paper particle of which diameter is equal to or less than 20 [μm].

In this case, the width a of the projection portion 312 is set to a value larger than 20 [μm] on the basis of the diameter of the paper particle. The width W of the recessed portion is set to a value less than 3.0 [mm] on the basis of the expression (3). The height H of the projection portion 312 is set to a value less than 0.6 [mm] on the basis of the expression (4).

On the other hand, the height H of the projection portion 312 is set to a value more than 20 [μm] based on the diameter of the paper particles. The width W of the recessed portion is set to a value more than 0.1 [mm] on the basis of the expression (4). The width a of the projection portion 312 is set to a value less than 2.2 [mm] on the basis of the expression (5). The pitch P between groove portions 311 is set to a value more than 0.7 [mm] on the basis of the expression (6). On the other hand, the pitch P between groove portions 311 is set to a value less than 5 [mm] on the basis of the relationship with the nip width.

Figure 6A:
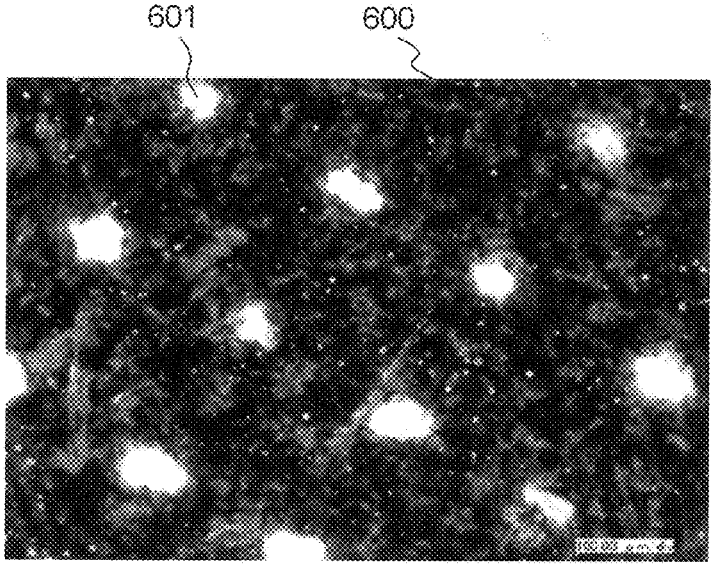
FIG. 6A is a schematic view for explaining a document to which paper particles are sticking.

FIG. 6A is a schematic view for explaining a document to which paper particles are sticking.

An image 600 of FIG. 6A is a figure obtained by enlarging a surface of a generally-available magazine. A white color portion 601 in the image 600 indicates paper particles. Each of paper particles 601 is extremely small, and in the example depicted in the image 600, the diameter of each particle of the paper particles 601 is less than 20 [μm].

Figure 6B:
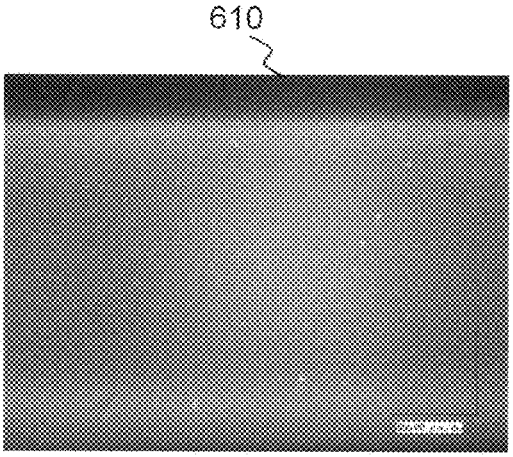
FIG. 6B is a schematic view for explaining a conventional feeding roller.
Figure 6C:
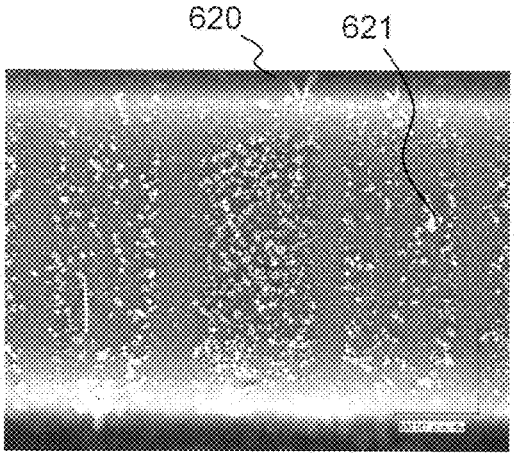
FIG. 6C is a schematic view for explaining a conventional feeding roller.

FIG. 6B and FIG. 6C are schematic views for explaining a conventional feeding roller.

An image 610 of FIG. 6B illustrates a surface of a conventional feeding roller before a document, to which paper particles are sticking, is conveyed. An image 620 of FIG. 6C illustrates a surface of a conventional feeding roller after the document, to which the paper particles are sticking, is conveyed. The surface of the conventional feeding roller as depicted in FIG. 6B and FIG. 6C does not have any projection portion, and is flat. As depicted in the image 610, before the document, to which the paper particles are sticking, is conveyed, nothing is sticking to the surface of the feeding roller, but as depicted in the image 620, after the document, to which the paper particles are sticking, is conveyed, much paper particles 621 are sticking.

Figure 7A:
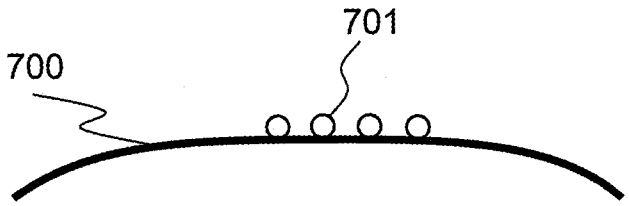
FIG. 7A is a schematic view for explaining a conventional feeding roller to which paper particles are sticking.
Figure 7B:
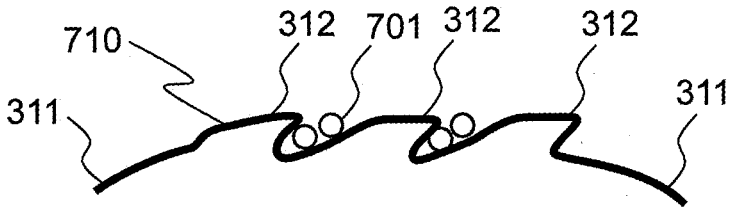
FIG. 7B is a schematic view for explaining the feeding roller 112 to which paper particles are sticking.

FIG. 7A is a schematic diagram for explaining the conventional feeding roller to which the paper particles are sticking, and FIG. 7B is a schematic view for explaining the feeding roller 112 to which the paper particles are sticking.

As depicted in FIG. 7A, when paper particles 701 are sticking to the surface 700 of the conventional feeding roller having no projection portion, the conveyed document thereafter come into contact with the paper particles 701 sticking to the surface 700. Accordingly, the frictional force between the conveyed document and the rubber of the surface 700 of the feeding roller is thereafter reduced, which significantly reduces the conveying performance. On the other hand, as depicted in FIG. 7B, the paper particles 701 are sticking to the surface 710 of the feeding roller 112 having the projection portions 312, the paper particles 701 get into between the projection portions 312, and the conveyed document thereafter does not directly come into contact with the paper particles 701. Accordingly, the frictional force between the conveyed document and the rubber of the surface 710 of the feeding roller is thereafter not reduced, and the reduction of the conveying performance is alleviated.

Figure 8:
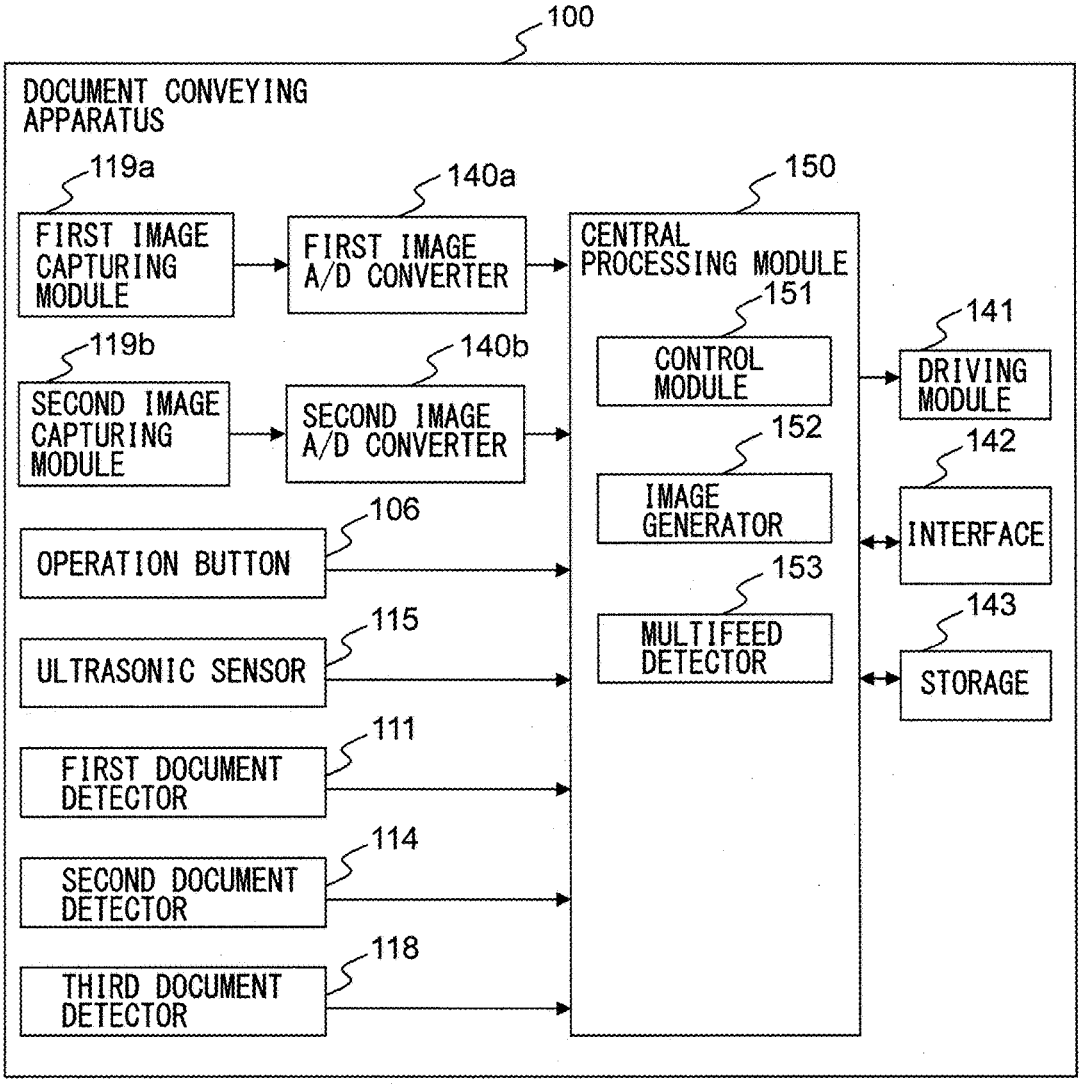
FIG. 8 is a block diagram illustrating a schematic configuration of a document conveying apparatus 100.

FIG. 8 is a block diagram illustrating a schematic configuration of the document conveying apparatus 100.

In addition to the above configuration, the document conveying apparatus 100 further includes a first image A/D converter 140*a*, a second image A/D converter 140*b*, a driving module 141, an interface 142, a storage 143, a central processing module 150, etc.

The first image A/D converter 140*a* converts an analog image signal, which is output from the first image capturing module 119*a*, into an analog digital conversion to generate digital image data, and outputs the digital image data to the central processing module 150. Likewise, the second image A/D converter 140*b* performs analog digital conversion to convert an analog image signal which is output from the second image capturing module 119*b* to generate digital image data, and outputs the digital image data to the central processing module 150. Hereinafter, these digital image data will be referred to as read images.

The driving module 141 includes one or more motors, and in accordance with a control signal from the central processing module 150, the one or more motors rotate the feeding roller 112, the brake roller 113, the first conveying roller 116, and the second conveying roller 120 to perform conveying operation of the documents.

The interface 142 includes, for example, an interface circuit based on a serial bus such as USB, and electrically connects with an information processing apparatus, not shown (for example, a personal computer, a portable information terminal, etc.), and transmits and receives read images and various kinds of information. Instead of the interface 142, an antenna for transmitting and receiving a wireless signal and a communication module having a wireless communication interface circuit for transmitting and receiving a signal via a wireless communication circuit in accordance with a predetermined communication protocol may be used. The predetermined communication protocol may be, for example, a wireless LAN (Local Area Network).

The storage 143 includes memory devices such as a RAM (Random Access Memory), a ROM (Read Only Memory), etc., a fixed disk device such as a hard disk, or a portable storage device such as a flexible disk, an optical disk, etc. The storage 143 stores computer programs, databases, tables, etc., used for various kinds of processing of the document conveying apparatus 100. The computer program may be installed on the storage 143 from a computer-readable, non-transitory medium such as a compact disk read only memory (CD-ROM), a digital versatile disk read only memory (DVD-ROM), or the like by using a well-known setup program or the like. Further, the storage 143 stores the read images.

The central processing module 150 has a CPU (Central Processing Unit), and operates based on a program stored in the storage 143 in advance. It should be noted that the central processing module 150 may be constituted by a DSP (digital signal processor), an LSI (large scale integration), etc. The central processing module 150 may be constituted by an ASIC (Application Specific Integrated Circuit), an FPGA (Field-Programming Gate Array), etc.

The central processing module 150 is connected to the operation button 106, the first document detector 111, the second document detector 114, the ultrasonic sensor 115, the third document detector 118, the first image capturing module 119*a*, the second image capturing module 119*b*, the first image A/D converter 140*a*, the second image A/D converter 140*b*, the driving module 141, the interface 142, the storage 143, etc., and controls each of these modules.

The central processing module 150 performs driving control of the driving module 141, document reading control of the image capturing module 119, etc., and obtains read images. The central processing module 150 includes a control module 151, an image generator 152, a multifeed detector 153, etc. Some of these components may be functional modules implemented by software or firmware running on a processor. Note that some of these components may be formed by independent integrated circuits, microprocessors or the like.

As described above in details, in the document conveying apparatus 100, paper particles sticking to the surface of a document are appropriately scraped off by the waveform shape of the projection portion 312, and therefore, the document conveying apparatus 100 can alleviate the reduction of the conveying performance caused by sticking of paper particles to the feeding roller 112. In addition, the user does not need to frequently clean the feeding roller 112 in order to remove the paper particles sticking to the feeding roller 112, and the convenience can also be improved.

In the document conveying apparatus 100, the feeding roller 112 includes both of the groove portion 311 and the projection portion 312, and accordingly, the document conveying apparatus 100, can alleviate the reduction of the conveying performance due to both of the paper particles and paper fibers at a time.

The projection portion 312 of the feeding roller 112 is formed by the emboss processing. For example, when projection portions are formed by forming a polishing marks with the grinding processing, it is necessary to perform processing upon withdrawing from the mold, and therefore, as compared with a case where projection portions are formed with the emboss processing, the cost increases. When the projection portions are formed by the grinding processing, the polishing marks (the height of the projection portion in particular) varies because of a pressurizing force, a pressurizing speed, etc., during the grinding processing, and therefore, it is difficult to obtain stable conveying performance.

When the polishing marks are against grains with respect to the document conveying direction, the polishing marks are abraded greatly, and therefore, when the projection portions are formed by the grinding processing, it is necessary to assemble the feeding roller so that the polishing marks are according to the grains with respect to the document conveying direction, and therefore, this increases the burden imposed on the assembly worker. In particular, when a pair of feeding rollers such as the feeding rollers 112*a*, 112*b* are used, when the polishing marks of the feeding rollers are different, the conveying force is reduced, and the chance of occurrence of skew becomes higher. In order to prevent such problems, the shapes of the attachment members of the feeding rollers are needed to be different so that the feeding roller 112*a* and the feeding roller 112*b* are attached in a wrong manner, but in such case, the production cost increases.

When the projection portions 312 of the feeding roller 112 are formed by the emboss processing, stable conveying performance can be obtained at a low cost and a less trouble can be obtained.

While preferred embodiments have been described above, it is not limited to the embodiments. For example, the document conveying apparatus may not be the image scanner, and may be a facsimile machine, an inkjet printer, a laser printer, a Multifunction Peripheral (MFP), etc.

According to the feeding roller, paper particles sticking to the surface of a document are appropriately scraped off by a regular pattern of a projection portion, and therefore, a document conveying apparatus can alleviate the reduction of the conveying performance caused by sticking of paper particles to a feeding roller.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A feeding roller having an external surface used for a document conveying apparatus comprising:

a plurality of groove portions arranged with a regular interval in a width direction of the feeding roller and formed into the external surface of the feeding roller; and a projection portion provided on the external surface between each pair of adjacent groove portions and formed in a single continuous portion from one edge to the other edge of the feeding roller in the width direction that scrapes off paper particles, wherein the projection portion has a waveform shape extending in the width direction of the feeding roller and wherein the waveform shape is a trapezoid waveform shape in a view from an outer side in a radius direction of the feeding roller, wherein a diameter of the external surface where a groove portion is formed is less than a diameter of the external surface where no groove portion and no projection portion are formed, wherein a diameter of the external surface where a projection portion is formed is larger than said diameter of the external surface where no groove portion and no projection potion are formed, and wherein each of the plurality of groove portions include a bottom portion formed by the external surface.

2. The feeding roller according to claim 1, wherein the waveform shape is in a trapezoid waveform shape including a plurality of parallel portions arranged in a dispersed manner and substantially in parallel with the groove portions and a leg portion connecting the plurality of parallel portions.

3. The feeding roller according to claim 2, wherein a height of the projection portion is more than 20 [μm], and less than $[(L - b - n \times a) \times \{1/(n - 1/2)\} \times (1/5)]$, where L denotes a nip width between the feeding roller and a roller facing the feeding roller, b denotes a width of the groove portion, n is a number of projection portions provided between the each pair of adjacent groove portions, and a denotes a width of the projection portion.

4. The feeding roller according to claim 2, wherein an angle formed by the parallel portion and the leg portion is equal to or more than 120 degrees and equal to or less than 150 degrees.

5. The feeding roller according to claim 2, wherein a distance between an upper base portion and a lower base portion in a trapezoid wave of the trapezoid waveform shape is equal to or more than ⅓ and equal to or less than ⅔ of a distance between trapezoid waves adjacent to each other.

* * * * *